US006036550A

United States Patent [19]

Naganawa et al.

[11] Patent Number: 6,036,550

[45] Date of Patent: Mar. 14, 2000

[54] CONNECTOR HOLDER

[75] Inventors: Masato Naganawa; Yutaka Ushiro; Junichi Tsuda, all of Osaka, Japan

[73] Assignee: Japan Solderless Terminal Manufacturing Co., Ltd., Osaka, Japan

[21] Appl. No.: 09/028,244

[22] Filed: Feb. 24, 1998

[30] Foreign Application Priority Data

Feb. 24, 1997 [JP] Japan ..... 9-056937

[51] Int. Cl.[7] ..... H01R 13/502

[52] U.S. Cl. ..... 439/701; 439/350

[58] Field of Search ..... 439/78, 345, 350–358, 439/372, 686, 701, 709

[56] References Cited

U.S. PATENT DOCUMENTS 4,964,817 10/1990 Kanai et al. .

5,281,161 1/1994 Kanai ..... 439/701

*Primary Examiner*—Khiem Nguyen

*Attorney, Agent, or Firm*—Antonelli, Terry, Stout & Kraus, LLP

[57] ABSTRACT

A connector holder (1) has an elongate front wall (2), an elongate and partitioning center wall (3) formed integral with, perpendicular to and along the inner edge of the front wall, and end walls (4, 4') extending perpendicular to the center wall and located at opposite ends of same. The end walls have latch means (6, 7 and 8) for engagement with the connectors of the pressure contacting type. A pair of spaces (5) for receiving the connectors are provided such that a side of each space facing the front wall is opened, with another side confronting the center wall also opened. The connector holder (1) further has lugs (11) that are capable of engaging with the entrances (26) of compartments formed in each connector (20), so that the electric wires received in the compartments are surely held in place.

2 Claims, 4 Drawing Sheets

CONNECTOR HOLDER

BACKGROUND OF THE INVENTION

The present invention relates to a connector holder designed to hold the so-called pressure contacting connectors arranged in two rows facing one another. Each connector of this type comprises a plurality of contacts placed in an insulated housing to be ready to receive wires that will be snapped into a pressure contact with those contacts.

The connector holders of the type mentioned above are known in the art as described for instance in the U.S. Pat. No. 4,964,817.

This prior art holder comprises an elongate front wall or apron. An elongate and partitioning center wall disposed perpendicular to the front wall extends along the inner edge thereof. The partitioning center wall is secured to said inner edge to be integral therewith. End walls lying perpendicular to the center wall are located at the opposite ends thereof. The end walls have latch means for engagement with the connectors. A pair of spaces for receiving the connectors are surrounded by and defined with the front, center and side walls, such that a side of each space facing the front wall is opened, with another side confronting the center wall also opened.

Parallel partitions which each connector comprises are of such a design that certain compartments for holding therein the respective contacts are separated one from another by the partitions. The top and the rear side of each compartment are open for the wire to be snapped in. A pair of retainers (hereinafter referred to as "strain relieves") are protrusions formed integral with the parallel partitions and on both the sides of each compartment, in order to retain each wire placed therein. These members listed above constitute an insulated housing for each connector. The open tops of the compartments will be closed with the center wall referred to above, when the connectors are set on the holder.

It is however to be noted here that only the strain relieves formed as the parts of the insulated housing do play a role to hold the wires in place, after the latter are connected to the connectors. It is difficult for such strain relieves to withstand well a strong stress that will be produced when the wires are bent, rotated, swung, pulled or wrenched. Those wires held in the connectors of the described type are usually caused to swing when the wiring work is done. If the insulated housing is undesirably pressed to the center wall due to the stress just mentioned above, then the strain relieves will more possibly fail to retain the wires in position.

SUMMARY OF THE INVENTION

The present invention was made in view of the problems that have been inherent in the prior proposal. An object of the present invention is therefore to provide at a reasonable manufacture cost a connector holder of a type that enables the connectors held thereon to more stably keep the wires in position.

The connector holder offered herein for connectors of the so-called pressure contacting type does also comprise, like the prior art one, an elongate front wall, an elongate and partitioning center wall disposed perpendicular to the front wall and extending along the inner edge thereof, the center wall being secured to the inner edge to be integral therewith, end walls extending perpendicular to the center wall and located at the opposite ends thereof, and the end walls having latch means for engagement with the connectors. The connector holder thus comprises a pair of spaces for receiving the pressure contacting type connectors, with these spaces being separated from each other by the center wall and defined by and with the front, center and side walls such that a side of each space facing the front wall is opened, with another side confronting the center wall also opened. Further, each of the connectors comprises parallel partitions designed such that compartments for holding therein respective contacts are separated one from another by the partitions. A relatively elongate top side and a rear side of each compartment are open to thereby provide an entrance to said compartment so that electric wires can be snapped into contact with the respective contacts. Strain relieves for retaining the wires are formed integral with both sides of rear ends of the parallel partitions, wherein the parallel partitions and the strain relieves are formed as parts integral with an insulated housing of each connector. However, in order to achieve the particular object set forth above, the center wall of the connector holder comprises such lugs that are engageable with the entrances of the compartments formed in each connector of the pressure contacting type.

In order to prevent the wires from slipping off the compartments, it may be sufficient for the lugs to engage at least with rear regions of the entrances so that the adjacent strain relieves are thus stopped with the lugs snot to rock away from each other. It will however be understood that each entrance covering its front to rear regions may more desirably be stopped entirely to further improve the wire retaining function of the strain relieves.

THE PREFERRED EMBODIMENTS

Figure 1:
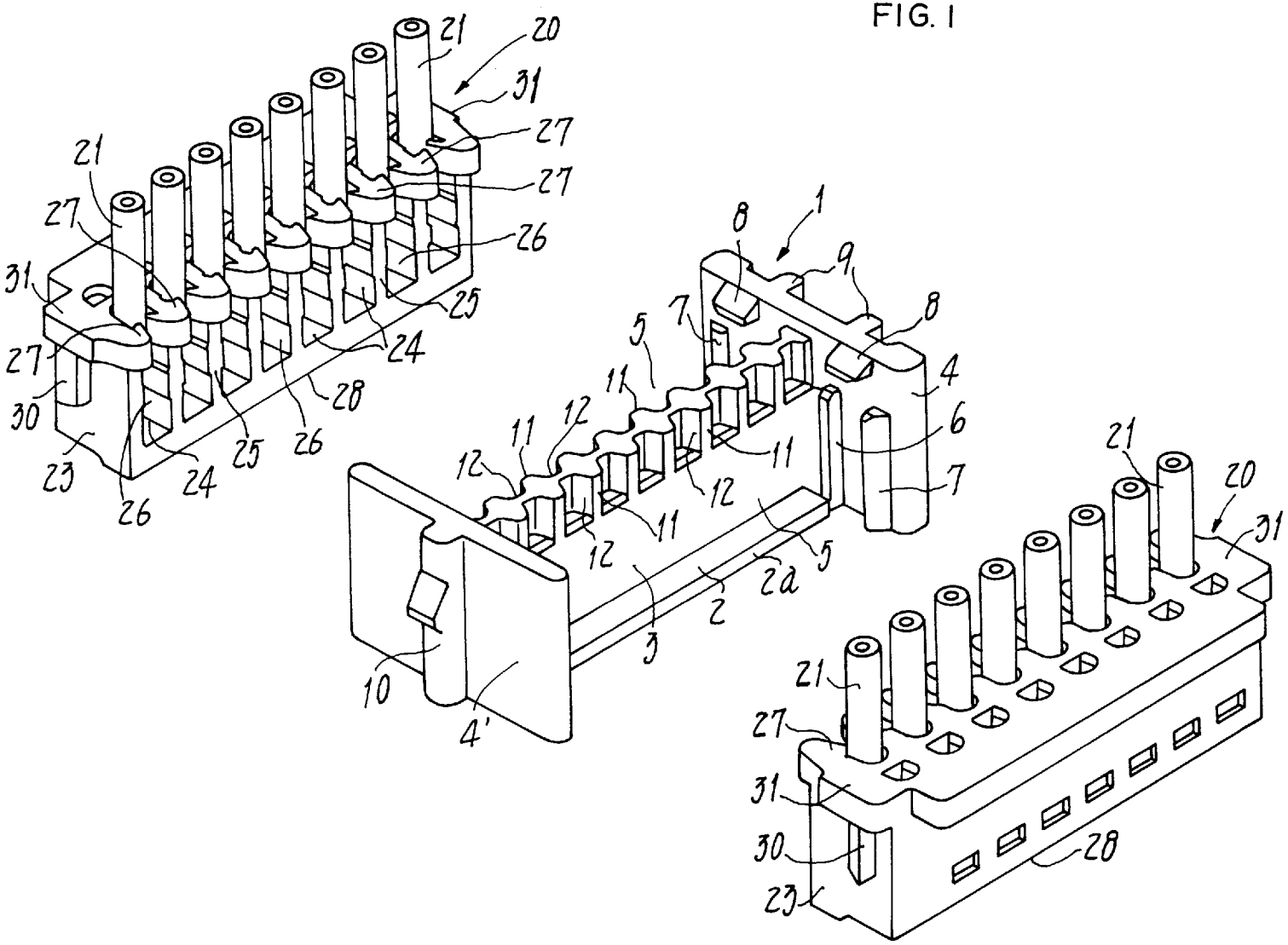
FIG. 1 is a perspective view of a connector holder provided herein to hold a pair of the pressure contacting type connectors.
Figure 2:
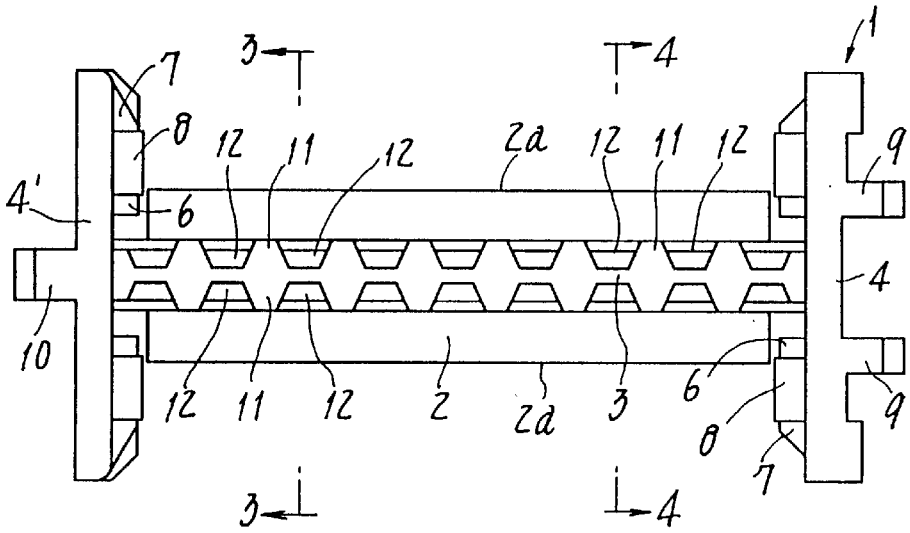
FIG. 2 is a plan view of the connector holder shown in FIG. 1.
Figure 3:
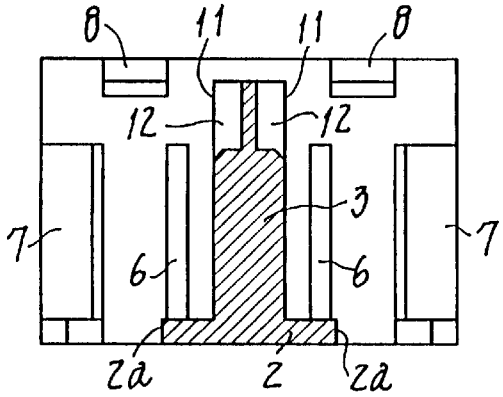
FIG. 3 is a cross section taken along the line 3—3 in FIG. 2.
Figure 4:
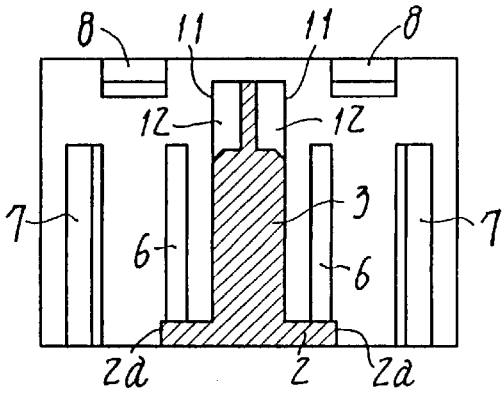
FIG. 4 is a cross section taken along the line 4—4 in FIG. 2.

Now some embodiments of the present invention will be described referring to the drawing.

FIG. 1 shows a connector holder 1 provided in accordance with the present invention and having a pair of the pressure contacting type connectors 20 and 20 to be set in place on the holder.

Figure 5:
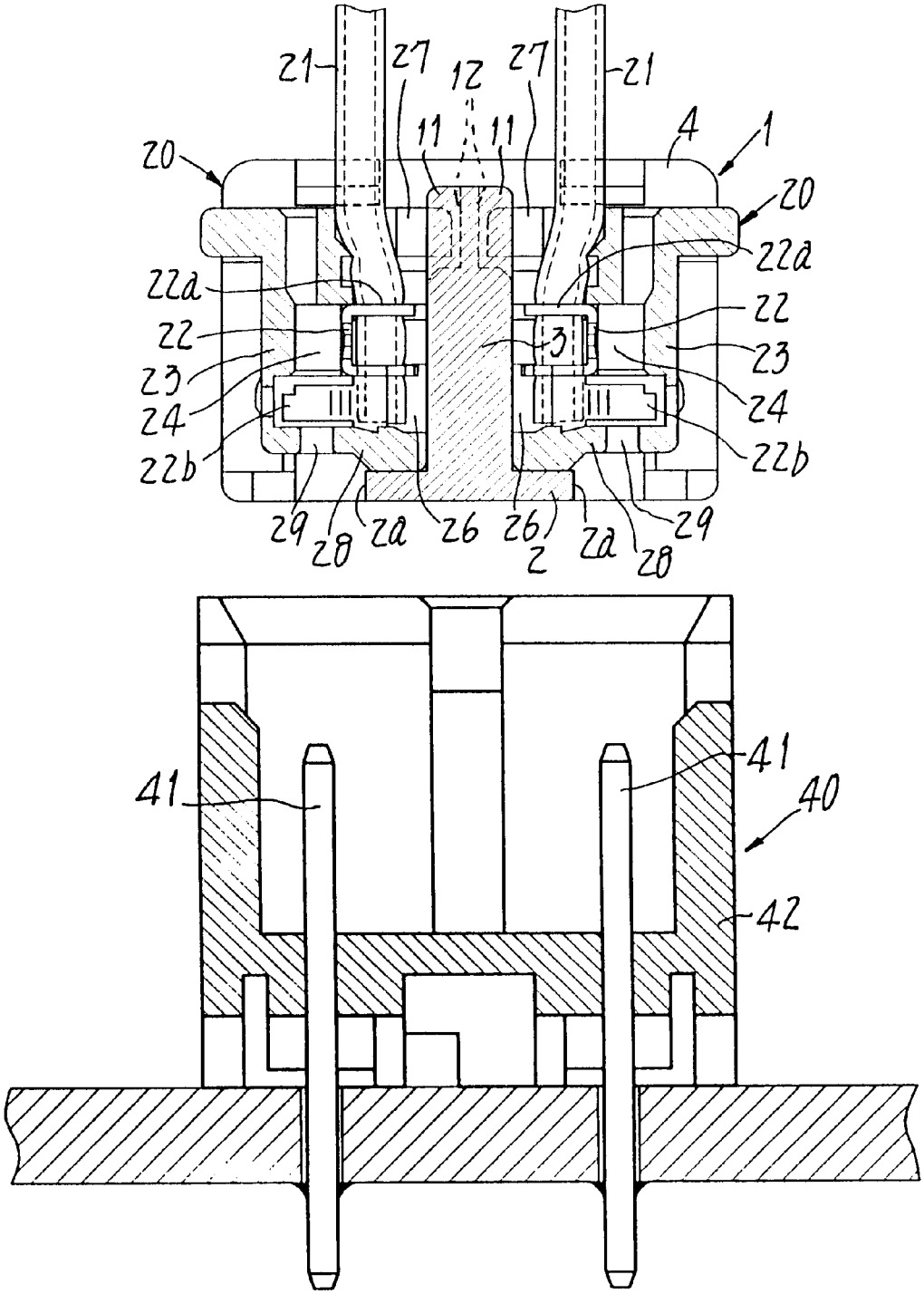
FIG. 5 is a front elevation of the connector holder in use, with some parts thereof shown in cross section.

Each connector 20 has a plurality of socket contacts 22 accommodated therein as shown in FIGS. 1 and 5, which contacts are to be brought into a pressure engagement with electric wires 21. Compartments 24 are formed in an insulated housing 23 of the connector. Those compartments are arranged at a constant pitch and in a row so that the contacts 22 placed in said compartments are isolated from each other. Each socket contact 22 consists of a first portion 22*a* for engaging with the wire and a second portion 22*b* continuing from the first portion. Pin contacts 41 protruding from a mating connector 40 will be fitted in the respective second portions 22*b* of the socket contacts. Parallel partitions 25 divide the insulated housing 23 into the compartments 24 to be separated from each other. A top side and a rear side of each compartment are open to provide an entrance thereto for the wire 21 to be snapped in the first portion 22*a*. At a rear region of each entrance 26, strain relieves 27 for hooking the wire 21 are formed integral with the adjacent partitions' portions facing one another. Those strain relieves 27 protrude from a top side of the housing. Each compartment 24 has a front wall 28, and an aperture 29 formed in and through this front wall is for insertion of the pin contact 41. Latch means 30 (see FIG. 1) formed integral with and protruding from opposite ends of the housing 23 (and extending in parallel with the compartments) do serve to keep it in position on the connector holder On the other hand, the connector holder 1 itself is a integral piece made of a relatively soft plastics such as Nylon 6.6™ and is of a structure as best seen in FIGS. 1 to 4. The connector holder comprises an elongate front wall 2 whose outer edges are intended to bear against the front walls 28 of the connectors'insulated housings 23, and a center wall 3 which is integral with an inner face of central elongate zone of the front wall. A pair of end walls 4 and 4' extending perpendicular to the center wall 3 and located at the opposite ends thereof also constitute the connector holder. The connector holder 1 thus has a pair of spaces 5 and 5 for receiving the pressure contacting type connectors. Each space has a rear open side confronting the front wall 2 and an outer open side confronting the center wall 3. Each of the end walls 4 and 4' has on its inner surface two pairs of inner and outer ridges 6 and 7 between which the latch means 30 is to be inserted to position the connector. Each end wall has further two detents 8 and 8 protruding therefrom to stop opposite side ends 31 of the rear wall of housing 23 in such a manner that each connector is prevented from slipping off the holder. The inner and outer ridges 6 and 7 extend in parallel with the center wall 3. Each detent 8 lying along the rear edge of the end wall 4 or 4' is located behind and between these ridges confronting one another. Further edges 9 and 10 formed on and integral with the outer face of said end walls are intended to engage with an insulated housing 42 of the mating connector 40 so that the present holder may fixedly fit in said mating connector.

The front wall 2 of the connector holder 1 is rendered narrow enough to make an outer edge of this front wall flush with that of the inner ridge 6. This structure is advantageous in that the apertures 29 for insertion of the pins and formed in the front wall 28 of the connector's 28 housing 23 may not interfere with the front wall 2 of the holder 1. Such a narrow front wall 2 will also curtail material consumption in forming the holder to thereby reduce manufacture cost.

The center wall 3 of the connector holder comprises lugs 11 formed in a row such that are engageable with and fittable in the open entrances 26 of the compartments 24 formed in each connector 20 of the pressure contacting type. In the illustrated embodiment, those lugs 11 are designed to engage with rear side wall faces defining regions of the entrances 26, so that the adjacent strain relieves 27 and 27 formed on those side wall faces are thus stopped with the lugs. However, each entrance covering its front to rear regions may be stopped entirely. Also in the illustrated embodiment, those strain relieves 27 protrude from top face of the connector housing lugs. Accordingly, recesses 12 are formed at regular interval in the center wall 3 so as to respectively fit on such strain relieves 27. Thus, the lugs 11 alternate one by one with the recesses 12. In a modified example wherein the strain relieves 27 are flush with the top face of insulated housing 23, those recesses 12 may be dispensed with and those lugs 11 may protrude from each side of the center wall 3.

Figure 6:
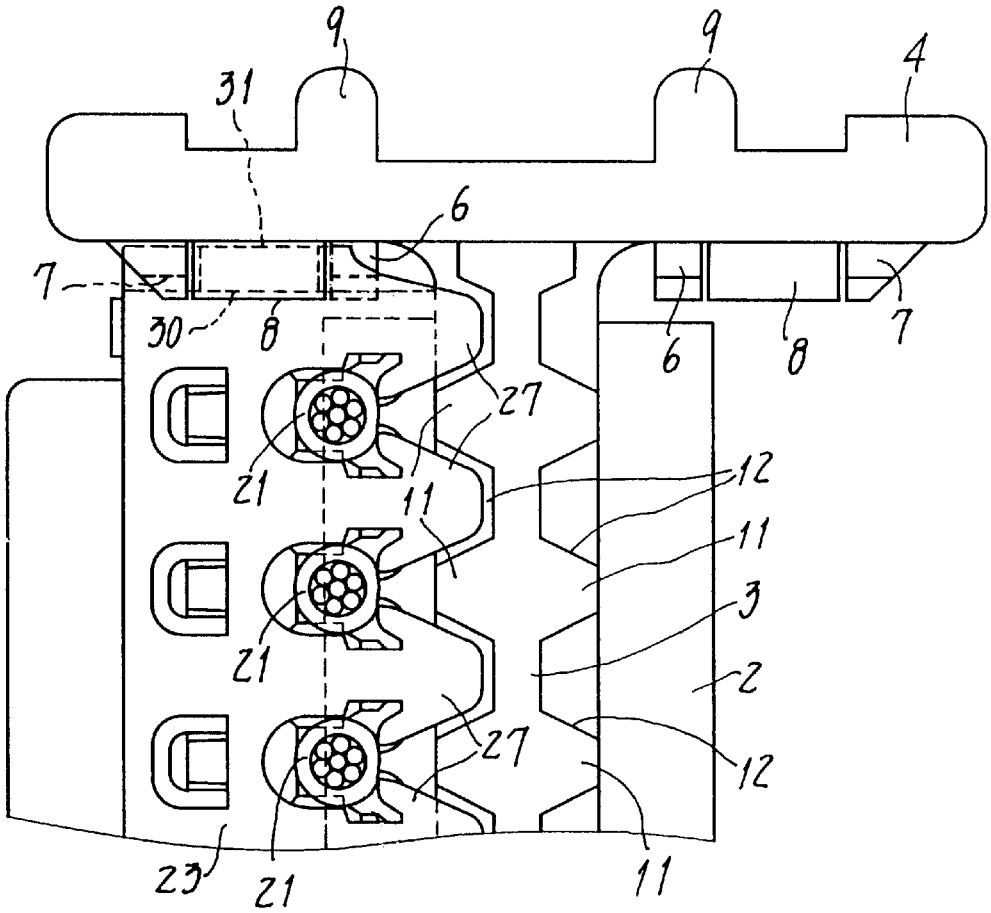
FIG. 6 is an enlarged and partial plan view of the connector holder having one connector held in position thereon.

FIG. 5 shows that the pressure-contacting connectors 20 and 2Q secured on the connector holder 1 of the described structure. Each connector 20 has its two side latch means 30 fitted in between the ridges 6 and 7, whereby the spaces 5 tightly accommodate the connectors at their correct position. The front wall 28 of each connector will thus abut against the corresponding front wall 2 of the holder. In this state, the detents 8 on both the sides of the holder are in engagement with the side ends 31 of the rear wall of housing 23 to thereby keep each connector immovably on the holder 1. The narrow front wall 2 of the holder does not hinder the pin contacts from making free access to the apertures 29 for them. As best seen in FIG. 6, each strain relief 27 for retaining the wires in the insulated housing 23 fits in the corresponding recess 12, with each lug 11 fitting in the entrance 26 formed between the adjacent strain relieves. Therefore, any external forces such as bending, rotating or wrenching the wires cannot expand the entrance between those strain relieves 27, and consequently their function of protecting the electric wires or leads from accidental removal is ensured.

In use of the connector holder holding thereon the connectors in a manner described hereinabove, the outer ridges 9 and 10 will be fitted in grooves (not shown) formed in the insulated housing 42 of the mating connector 40. The pin contacts 41 of this connector will at the same time be brought into the respective compartments 24 to thereby be gripped by the respective second portions 22*b* of the socket contacts 22, thus making an electric connection between them.

In summary, the connector holder provided herein has a row of the lugs protruding into the open entrances of the compartments formed in each pressure contacting type connector. The strain relieves which both the rear side faces of each of parallel partitions comprise to confront one another will be hindered from displacing away from each other even if any noticeable stress of bending or wrenching the wires are applied thereto. Any accident of undesirable slipping off of the wires is thus surely avoided.

What we claim is:

1. A connector holder for holding connectors thereon, the holder comprising:

an elongate front wall disposed at each of two opposite sides of the holder;

an elongate and partitioning center wall disposed perpendicular to the front wall and extending along an inner edge thereof, with the center wall being secured to the inner edge to be integral therewith;

end walls extending perpendicular to the center wall and located at the opposite ends thereof, with the end walls having latch means for engagement with the connectors; and a pair of spaces for receiving the connectors, with the spaces being separated from each other by the partitioning center wall and defined by and with the front, center and end walls such that a side of each space facing the front wall is opened, with another side confronting the center wall also opened, each of the connectors being of the pressure contacting type and comprising:

parallel partitions designed such that compartments for holding therein respective contacts are separated one from another by the partitions;

an elongate top side and a rear side of each compartment being open to thereby provide an entrance to said compartment so that electric wires can be snapped into contact with the respective contacts; and strain relieves for retaining the wires in position, with the strain relieves being formed integral with both sides of rear ends of the parallel partitions, wherein the parallel partitions and the strain relieves are formed as parts integral with an insulated housing of each connector, and the connector holder further comprising lugs that are capable of engaging with the entrances of the compartments formed in each connector of the pressure contacting type.

2. A connector holder as defined in claim 1, wherein the contacts of the connectors are socket contacts with which pin contacts of a mating connector engage, and wherein apertures for insertion of the pin contacts are formed in and through the front wall of the insulated housing of each connector, and the front wall of the holder is narrow enough not to interfere with the apertures formed in the connectors held on the holder.

* * * * *